US008375598B2

(12) United States Patent
Khoshnood

(10) Patent No.: US 8,375,598 B2
(45) Date of Patent: Feb. 19, 2013

(54) APPARATUS AND METHOD FOR PROVIDING AND MAINTAINING DRY AIR CONDITIONS FOR STORAGE OF MOISTURE-SENSITIVE ELECTRONIC COMPONENTS

(76) Inventor: Bahman Khoshnood, Boca Raton, FL (US)

( * ) Notice: Subject to any disclaimer, the term of this patent is extended or adjusted under 35 U.S.C. 154(b) by 817 days.

(21) Appl. No.: 12/567,187

(22) Filed: Sep. 25, 2009

(65) Prior Publication Data

US 2010/0071227 A1 Mar. 25, 2010

Related U.S. Application Data

(60) Provisional application No. 61/101,210, filed on Sep. 30, 2008, provisional application No. 61/099,964, filed on Sep. 25, 2008.

(51) Int. Cl.
*F26B 3/00* (2006.01)

(52) U.S. Cl. ..... 34/202; 34/87; 34/201; 34/380; 34/90

(58) Field of Classification Search ..... 34/443, 34/192, 195, 197, 201, 202, 218, 380, 211, 34/212, 528, 603, 90, 103, 104; 62/78, 457.1, 62/382; 312/31–31.03; 29/825, 832, 840, 29/739, 740, 833, 836; 206/213.1, 409; 414/517
See application file for complete search history.

(56) References Cited

U.S. PATENT DOCUMENTS 201,131 A * 3/1878 Tiffany ..... 34/211
502,237 A * 7/1893 Proctor ..... 312/301
1,422,620 A * 7/1922 Power ..... 34/562
1,564,782 A * 12/1925 Harris ..... 34/407
3,424,231 A * 1/1969 Truhan ..... 165/230
3,553,426 A * 1/1971 Fink ..... 219/406
3,943,842 A * 3/1976 Bills et al. ..... 99/473
4,030,476 A * 6/1977 Hock ..... 126/246
4,108,139 A * 8/1978 Gilliom et al. ..... 126/21 A
5,025,570 A * 6/1991 Moffat ..... 34/72
5,364,045 A * 11/1994 Clayton et al. ..... 242/588.6
5,519,188 A * 5/1996 Yuichi et al. ..... 219/407
6,018,885 A * 2/2000 Hill ..... 34/202
6,302,786 B1 * 10/2001 Bauer et al. ..... 454/339
6,622,399 B1 * 9/2003 Theriault et al. ..... 34/380
6,845,569 B1 * 1/2005 Kim ..... 34/106
6,877,219 B1 * 4/2005 Theriault et al. ..... 29/832
6,973,740 B2 * 12/2005 Meyer ..... 34/224
6,990,750 B2 * 1/2006 Theriault et al. ..... 34/380
7,137,194 B2 * 11/2006 Theriault et al. ..... 29/832
7,191,546 B2 * 3/2007 Maruca ..... 34/201
7,883,886 B2 * 2/2011 Swinkels ..... 435/291.4
7,913,419 B2 * 3/2011 Tomasi et al. ..... 34/595
2004/0134087 A1 * 7/2004 Meyer ..... 34/90
2004/0143989 A1 * 7/2004 Theriault et al. ..... 34/380
2004/0221475 A1 * 11/2004 Theriault ..... 34/523
2005/0061370 A1 * 3/2005 Higer et al. ..... 137/221
2005/0138801 A1 * 6/2005 Theriault et al. ..... 29/832
2007/0068035 A1 * 3/2007 Theriault ..... 34/523
2007/0125807 A1 * 6/2007 Lucas et al. ..... 222/361
2007/0193058 A1 * 8/2007 Zarembinski ..... 34/202
2007/0251116 A1 * 11/2007 Huang et al. ..... 34/202
2010/0011609 A1 * 1/2010 Park et al. ..... 34/88
2010/0071227 A1 * 3/2010 Khoshnood ..... 34/443

(Continued)

*Primary Examiner* — Kenneth Rinehart
*Assistant Examiner* — Bao D Nguyen
(74) *Attorney, Agent, or Firm* — John C. Smith

(57) ABSTRACT

An enclosure for storing of moisture sensitive devices (MSD's). The enclosure includes a plurality of compartments, each continuously purged with dry air supplied by a commercially available de-humidifier. MSD's housed in said compartments are thus protected from absorbing moisture which could cause cracking of the devices after being mounted on printed circuit boards and subjected to the high temperatures associated with wave solder and solder reflow processes.

10 Claims, 7 Drawing Sheets

U.S. PATENT DOCUMENTS

2010/0088916 A1* 4/2010 Romanek ..... 34/87
2010/0132208 A1* 6/2010 Moon et al. ..... 34/82
2010/0139223 A1* 6/2010 Ryan ..... 55/429
2010/0205992 A1* 8/2010 Morris ..... 62/246
2011/0047814 A1* 3/2011 Watson et al. ..... 34/507

* cited by examiner

APPARATUS AND METHOD FOR PROVIDING AND MAINTAINING DRY AIR CONDITIONS FOR STORAGE OF MOISTURE-SENSITIVE ELECTRONIC COMPONENTS

CROSS-REFERENCE TO RELATED INVENTIONS

This application claims the priority benefit of U.S. Provisional Patent Application No. 61/101,210, filed Sep. 30, 2008 and U.S. Provisional Patent Application No. 61/099,964, filed Sep. 25, 2008, each of which is hereby incorporated herein by reference in their entirety.

BACKGROUND OF THE INVENTION

1. Field of the Invention

This invention relates to the storage of electronic moisture sensitive devices (MSDs) prior to mounting onto a printed circuit board. More particularly, this invention relates to humidity-free enclosures for storing electronic moisture sensitive devices (MSDs) in a dry atmosphere thereby minimizing moisture damage to the MSDs prior to and while soldering them onto a printed board.

2. Description of the Background Art

The process for fabricating printed circuit board (PCB) assemblies for electronic equipment involves mounting electronic components onto the PCB and then heating the PCB in a solder re-flow oven, as in the case of surface mount devices, or in a wave solder machine, in the case of pin-through-hole devices. Unfortunately, electronic components are sensitive to moisture absorption during storage prior to being mounted onto the PCB. Such moisture absorption can frequently later result in damage to the components in the form of cracks due to thermal expansion, or moisture overpressure, of the residue moisture once the components are mounted onto the PCB and exposed to the high oven temperatures associated with the solder re-flow or wave-solder process. Once cracking occurs, air and moisture may contact the circuitry inside the package causing it to corrode and ultimately fail. It is therefore desirable that the electronic components be stored in a dry atmosphere before being mounted onto the PCB such that they will be as free of moisture as possible before they are mounted and soldered in place.

Presently there exist many ways to minimize the moisture damage to electronic components. One method involves subjecting the components to a slow bake process to drive out moisture prior to their mounting and soldering onto the PCB. However, the baking of the electronic components requires an extra step in the PCB fabrication process thereby increasing manufacturing time and cost.

Another method for minimizing moisture damage to electronic components comprises storing them in an enclosure providing a dry condition until just prior to mounting and soldering them onto the PCB. U.S. Pat. No. 6,622,399 entitled "Apparatus and Method for Maintaining a Dry Atmosphere to Prevent Moisture Absorption and Allow Demoisturization of Electronic Components" and U.S. Pat. No. 7,137,194 entitled "Apparatus and Method for Maintaining a Dry Atmosphere in Surface Mount Device Placement Machine", the disclosure of each of which is hereby incorporated by reference herein, disclose known methods for minimizing moisture damage. Unfortunately, however, these storage enclosures involve exposing all the components in the enclosure to the ambient humid atmosphere when only one component is being withdrawn from the enclosure.

Therefore, one object of this invention is that it may provide an improvement which overcomes the aforementioned inadequacies of the prior art devices and provides an improvement which is a significant contribution to the advancement of the electronic component storage art.

Another object of this invention is that it may provide a storage enclosure employing single component packages stored in single storage compartments allowing a component to be removed from its storage compartment without interfering with any other component in another storage compartment of the enclosure assembly.

Another object of this invention is that it may provide a storage enclosure assembly employing single component packages stored in single storage compartments allowing a component to be loaded into its storage compartment without interfering with any other component in any other compartment of the storage enclosure.

The foregoing has outlined some of the pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Various embodiments of the invention may have none, some, or all of these mentioned objects. Accordingly, these objects or other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

For the purpose of summarizing the invention, this disclosure provides an apparatus and method for inventory control and storage of moisture sensitive printed circuit board components, such as surface mount components, in a dry atmosphere. Conventionally, electronic components are packaged and supplied on reels or in trays, known as waffle trays. The apparatus of the disclosure comprises a storage enclosure assembly, which may be stationary or on wheels, comprising a plurality of storage compartments for housing of the reels and waffle trays, and a dry air delivery system.

A sealed compartment door provides access to each of the compartments. The storage compartments are preferably configured to hold up to four waffle trays or from one to four reels depending on the sizes of the reels. Dry air supply and manifolds in the form of secondary chambers are operatively interconnected in parallel to a dry air delivery system for providing a supply of dry air to the plurality of storage compartments. The dry air delivery system preferably provides a supply of dry air, but other appropriate gases may be utilized.

In certain embodiments, the dry air supply and manifolds are operatively interconnected to each storage compartment in parallel to a dry air delivery system in such a manner that the dry air flow is allowed only when the storage compartment contains one or more reels or trays and the door is closed, thereby assuring that dry air is supplied to the storage compartment only after the reels or trays are loaded therein.

More particularly, when the compartment door is opened for inserting the reels or trays, a valve assembly located at the back of the storage compartment closes off airflow to the storage compartment to prevent the intrusion of a high concentration of ambient moist air into the secondary chambers. Once the reels or trays are loaded into the storage compartment and the door is closed, the valve assembly re-opens to allow the flow of dry air into the storage compartment.

Conversely, upon opening the compartment door to remove the reels and trays, the valve assembly closes to stop the flow of dry air into the storage compartment and to preclude the humid moist air from entering the dry air delivery manifold. Preferably, if no other reels or trays have been loaded into the storage compartment once the door is reclosed, the valve assembly remains closed, thereby precluding any residual moisture in the compartment from entering into the dry air delivery system.

In other embodiments, the dry air supply and manifolds formed from secondary chambers are operatively interconnected to each storage compartment in parallel to a dry air delivery system in such a manner that the dry air flow is accessible to the storage compartments on a continuous basis, thereby assuring continuous purging of the compartment with moisture-free air without regard to whether the compartment door is opened or closed or whether any reels or trays have been inserted or removed.

More particularly, when the compartment door is opened for insertion or removal of the reels or trays, any moisture entering the compartment due to exposure to ambient air is quickly purged from the storage compartment as soon as the compartment door is closed.

Purging takes place as dry air from the secondary chambers enters the compartment through a small hole, while contaminated air exits via another small hole connected to the return duct. From here it is directed by forced convection back to the dry air delivery unit where it is exposed to desiccants and dried before being circulated back into the supply duct. When any compartment door is opened, the forced convection mechanism will stop which in turn isolates all other compartments from any moisture present in the opened chamber. The flow of dry air resumes as soon as the compartment door is closed and latched.

Accordingly, the apparatus and method of the invention may therefore allow for single compartment, single location control with total flexibility, allowing for opening and closing of only one small compartment at a time to reduce the effects of ambient moist air contamination of the dry air supply.

The foregoing has outlined rather broadly the more pertinent and important features of the present invention in order that the detailed description of the invention that follows may be better understood so that the present contribution to the art can, be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and possible objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENTS

Figure 1A:
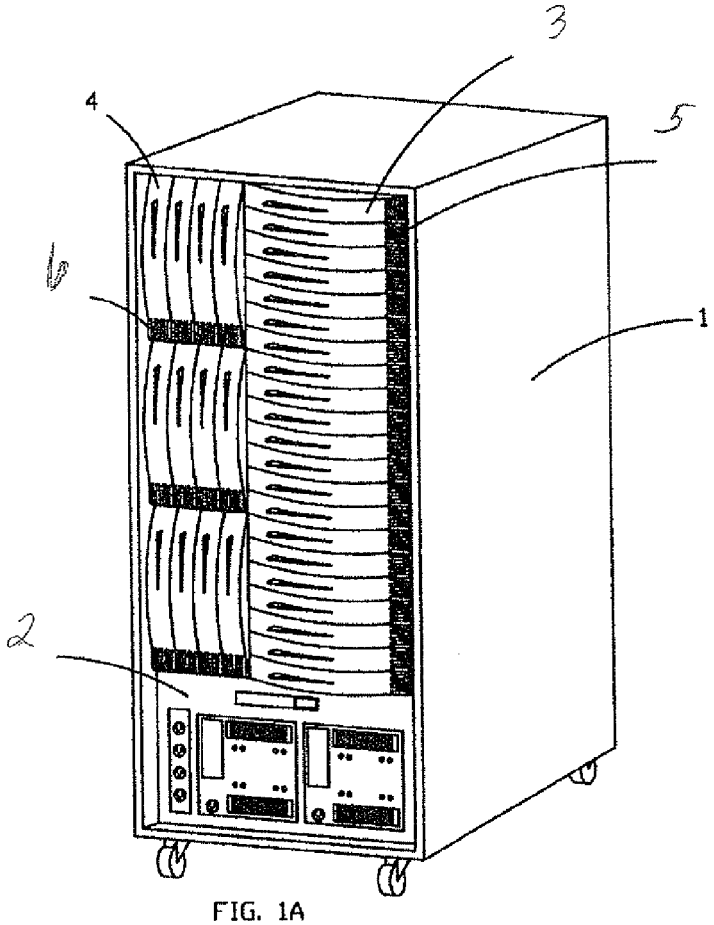
FIG. 1A illustrates an example enclosure in accordance with one embodiment of the present disclosure comprising a plurality of individual component compartments and a dry air delivery system.

Referring to FIG. 1A, a large enclosure assembly 1 is shown containing a plurality of component storage compartments and a dry air delivery system 2. Although the dry air delivery system 2 utilized in the embodiment depicted in FIG. 1A is comprised of a commercially available dehumidifier integrated into the enclosure assembly itself and capable of delivering dry air to all of the storage compartments, other forms of dehumidifiers or equipment capable of providing a continuous flow of dry air would suffice. Such as, for example, the source providing a continuous flow of dry air could be located external to the enclosure assembly 1 and then operatively coupled to the enclosure assembly 1 by way of hoses and the like to provide a continuous flow of dry air to the storage compartments 3 and 4. In the configuration depicted, twenty-one horizontal storage compartments 3 and twelve vertical compartments 4 are provided. It should be understood, however, that other combinations and arrangements of horizontal and vertical storage compartments 3 and 4 may be provided depending on the quantities required for a particular application. The storage compartments 3 and 4 are generally accessed by individual doors hinged or pivotally coupled at the right 5 in the case of the horizontal compartments 3, or at the bottom 6 in the case of the vertical compartments 4. The storage compartment doors, which preferably embody soft, elastomeric seals, are held tightly closed by means of spring latches (not shown in FIG. 1A but see FIG. 2A and discussion) so the storage compartment interiors are isolated from ambient air. Although the enclosure assembly 1 illustrated in FIG. 1A employs the use of hinges and spring latches to forcibly hold the storage compartment doors in place, other various fastening means and soft pliable materials commonly used in industry for accomplishing container or compartment sealing tasks may be applied to the storage compartment doors so to accomplish the same sealing effect of the storage compartments 3 and 4.

Figure 1B:
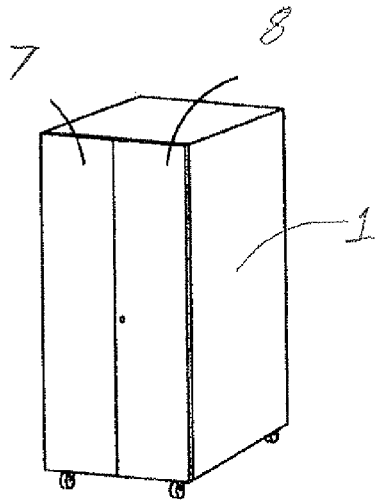
FIG. 1B illustrates the example enclosure of FIG. 1A having additional main front doors in a closed position.

Referring further to FIG. 1B, a smaller scale drawing of the enclosure assembly 1 is illustrated having first and second main doors 7 and 8 operatively coupled to the front of the enclosure assembly 1. These first and second main doors 7 and 8 may be closed for added protection of the enclosure's contents and locked for added security.

Further, each of the horizontal and vertical storage compartments 3 and 4 in the enclosure assembly 1 is preferably provided with a bar code label to identify the components stored within. A bar code scanner connected to a microprocessor of the types commonly used in the industry for bar code reading can then be used to locate components in the enclosure assembly 1, as well to provide inventory control by keeping track of which components are installed or removed from the enclosure assembly 1.

Figure 2A:
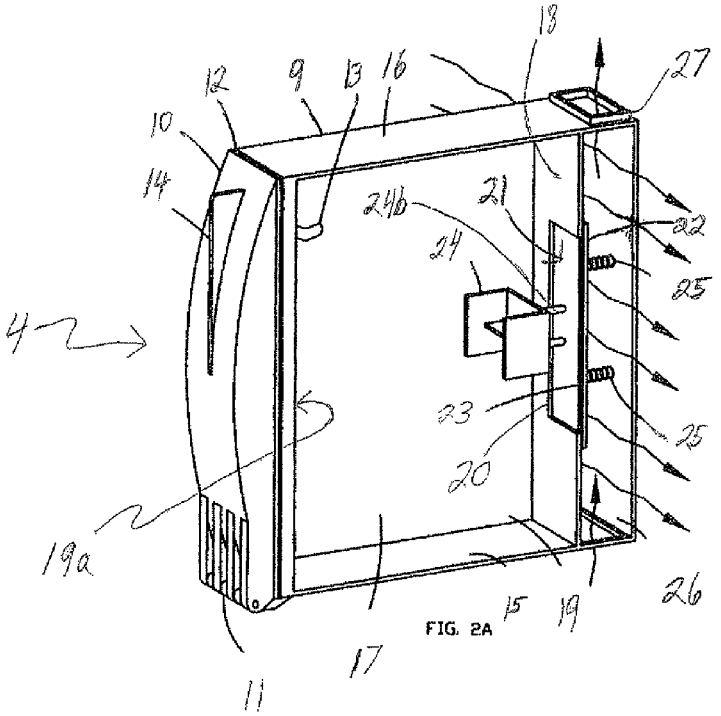
FIGS. 2A-B illustrate the details of the interior mechanism within one embodiment of a component compartment of the enclosure in FIG. 1A.

Referring now to FIG. 2A, the details of the interior mechanism within each vertical storage compartment 4 are illustrated. The details of the interior mechanism within the horizontal storage compartments 3 are identical to that of the vertical storage compartments 4. The horizontal and vertical storage compartments 3 and 4 are preferably constructed of molded plastic containing an electro-static dissipative additive to prevent static electricity build-up which could cause damage to sensitive electronic components. The main housing 9 is preferably molded of black plastic, whereas the door 10 is preferably molded of clear, transparent plastic. The door 10 comprises a hinge 11, an elastomeric seal 12 and a spring latch 13. The door is opened manually by grasping and pulling on molded wing 14. The main housing 9 is further sealed from ambient air by bottom wall 15, top wall 16 and left side wall 17. The right side wall of the main housing 9, opposite the left side wall 17, is formed by the left side wall 17 of another identical main housing 9 of an adjacent vertical storage compartment 4 which is bonded to the first vertical storage compartment 4 to form a sealed cavity. Additional vertical storage compartments 4 are bonded to each other in a likewise manner until the desired number of storage compartments 4 is achieved. The assembly of horizontal storage compartments 3 is performed in a similar manner and until the desired number of horizontal storage compartments 3 is achieved. A flat wall section (not shown) is bonded in place to seal the last of the vertical storage compartments 4 in the stack and likewise for the last of the horizontal storage compartments 3 in the stack.

FIG. 2A depicts an empty vertical storage compartment 4 (no components installed). The rear wall 18 of the vertical storage compartment 4 is integrally molded to the bottom, top and left side walls 15, 16 and 17 respectively as well as the right side wall to form the main chamber 19 having a front opening 19*a* of the vertical storage compartment 4. The rear wall 18 has an opening 20 that is sealed off by a means for regulating flow in the form of a valve assembly 21 comprised of a baffle 22, an elastomeric seal 23, an actuator 24, extension posts 24*b* and springs 25. The springs 25 keep the valve assembly 21 tightly closed to further seal the vertical storage compartment 4. Adjacent to the rear wall 18 is a secondary chamber 26 which is supplied by air from the dry air delivery system 2 (FIG. 1). All of the secondary chambers 26 containing the dry air are joined by connections formed by sealing gaskets 27 at both ends of the secondary chamber 26 such that dry air flows through and permeates all of the horizontally and vertically stacked storage compartments 3 and 4 as represented by the wavy arrows in FIGS. 2A-B.

Figure 2B:
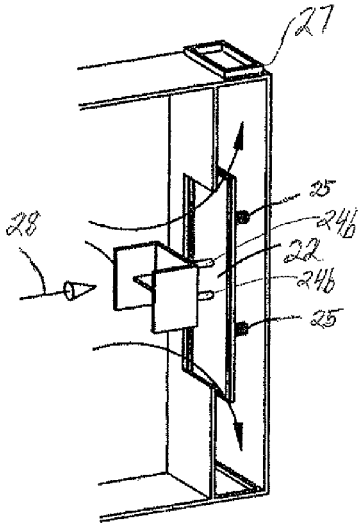

FIG. 2B shows a partial view of the vertical storage compartment 4 which depicts what happens when a reel, waffle tray or other commonly used carrier, containing electronic components is installed in the storage compartment 4. First the door 10 is opened. As soon as the reel or tray component carrier(s) is/are placed in the main chamber 19 through the front opening 19*a* and the door 10 is closed and latched, the reel or tray(s) containing the components contacts the actuator 24 of the valve assembly 21 and forcibly moves it and, by way of the extension posts 24*b*, the attached baffle 22 in the direction 28 causing the springs 25 to compress, allowing air in the main chamber 19 to mix with dry air from the secondary chamber 26, as depicted by the curved arrows. Moisture trapped in the main chamber 19 thus dissipates into the secondary chamber 26. Since the secondary chamber 26 is being continuously supplied with de-humidified air, and the main chamber 19 is sealed from ambient air, it is only a matter of a short time before the dry air stabilizes in both chambers 19 and 26 and the electronic devices become protected in a dry atmosphere.

When door 10 is opened for removal of a component reel or waffle tray, springs 25 decompress and push the component reel or tray out slightly as the valve assembly 21 closes and once again seals the opening 20 of the rear wall 18 of the main chamber 19 preventing the flow of new moist ambient air from permeating into the secondary chamber 26. This results in the dry air supply contained and flowing in the secondary chamber 26 having minimal exposure to moist ambient air, and, at the same time, does not interfere with the dry air atmosphere surrounding any other components stored in other horizontal or vertical storage compartments 3 and 4 in the enclosure assembly 1. Through this process with enclosure assembly 1 and the valve assembly 21, the single component, single location benefit is achieved.

Figure 3A:
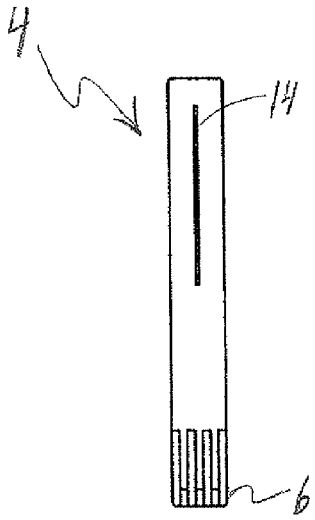
FIG. 3 illustrates one example of a large component storage reel placed in position within a vertical component compartment in accordance with the enclosure in FIG. 1A.
Figure 3B:
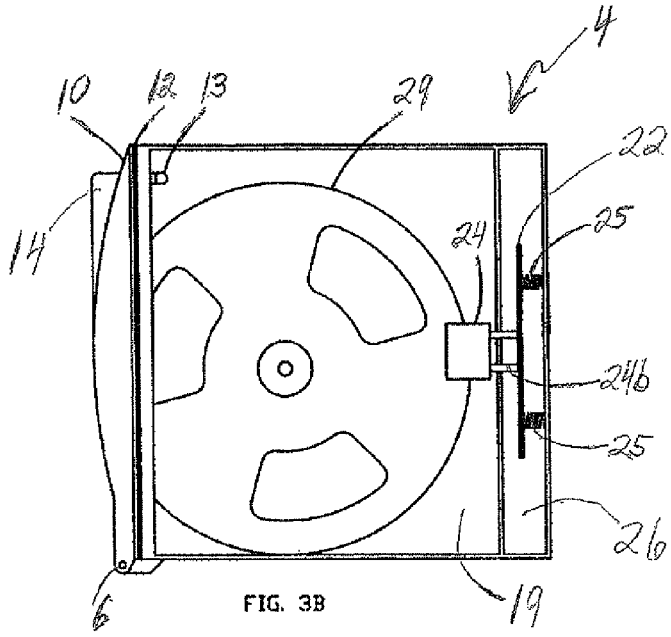
Figure 3C:
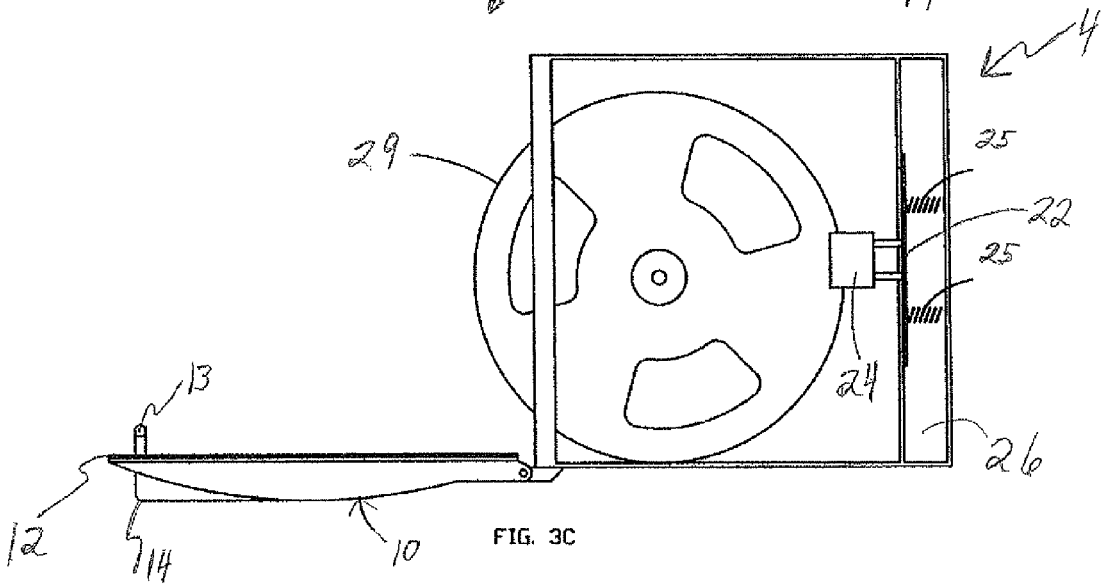

The disclosed embodiment is further described in FIG. 3 which shows a particular configuration where a large component reel 29 is installed in a vertical storage compartment 4. The front view of a vertical storage compartment 4 is shown in FIG. 3A, while the side view is shown FIG. 3B. Door 10 is closed against elastomeric seal 12 and held in position via spring latch 13. The valve assembly 21 is held open by action of the door 10 pushing on reel 29, which in turn pushes on actuator 24 that is coupled to the baffle 22, by way of the extension posts 24*b*, to forcibly compress springs 25 and translate the baffle 22 away from the opening 20 in the rear wall 18 thereby opening the valve assembly 21. This exposes the main chamber 19 of the vertical storage compartment 4 to the dry air supply flowing in the secondary chamber 26 from the dry air delivery system resulting in the reel components being stored in a dry atmosphere. FIG. 3C shows the door 10 opened in preparation for removal of the large component reel 29.

It can be seen from FIG. 3C that the component reel 29 is pushed out slightly as springs 25 decompress upon the opening of door 10 which removed the translational force originally exerted by door 10 when it was closed. The decompressing of the springs 25 creates a translational movement of the actuator 24 and baffle 22 in the direction of the door 10 thereby closing the opening 20 in the rear wall 18 by way of the baffle 22 and its elastomeric seal 23 contacting the rear wall 18 thus preventing any contamination of the dry air flowing in the secondary chambers 26 by any new moist ambient air. Once the component reel 29 is removed and the door 10 is closed, the valve assembly 21 remains in its closed position until another package of components is installed. See FIG. 2A.

Figure 4:
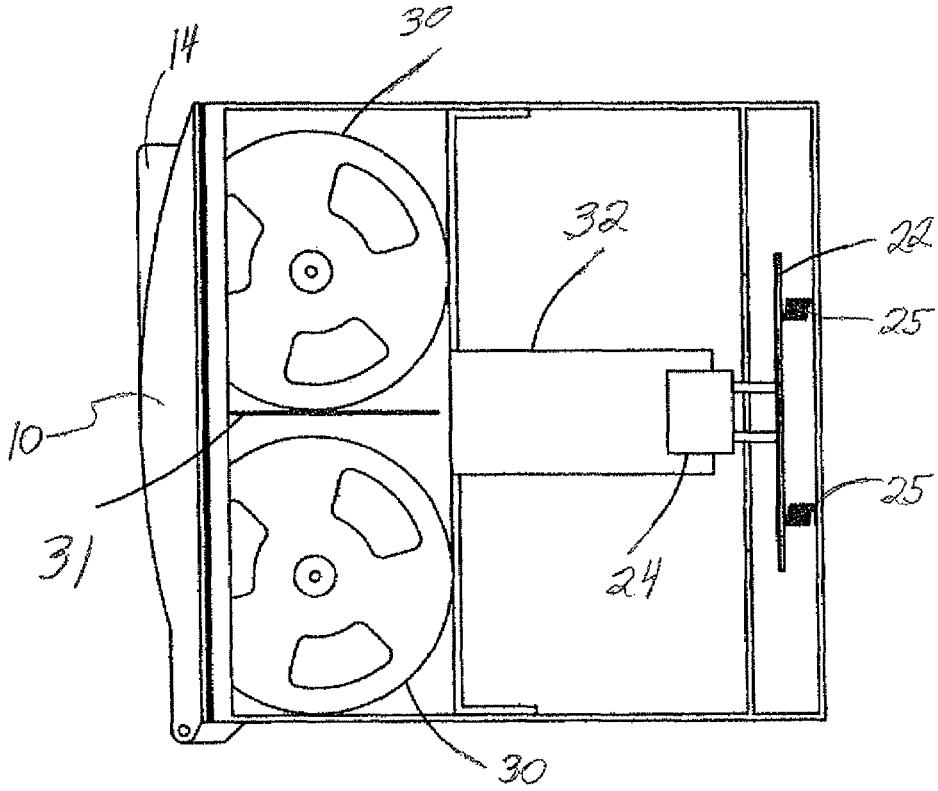
FIG. 4 illustrates one example of small component storage reels placed in position within a vertical component compartment in accordance with the enclosure in FIG. 1A.

The disclosed embodiment is further described in FIG. 4 wherein another particular configuration is illustrated where two small component reels 30 are installed in a vertical storage compartment 4. In this configuration a horizontal partition 31 has been installed in the storage compartment 4 to create two levels, thus allowing the accommodation of two small component reels 30. The horizontal partition 31 is preferably molded of black plastic containing an electro-static dissipative additive to prevent static electricity buildup and is frictionally coupled to the left side wall 17 and the right side wall of the vertical storage compartment 4 (right side wall not shown but is formed from the left side wall 17 of the next adjacent vertical storage compartment 4). A spacer 32 is included to allow either one or both of the small component reels 30 to contact the actuator 24 and resultingly open the valve assembly 21 in a similar fashion as described previously herein. The spacer 32 is preferably molded of black plastic containing an electro-static dissipative additive to prevent static electricity buildup and can be removed when necessary to accommodate larger component reels in the vertical storage compartment 4. The horizontal partition 31 may also be coupled to and made integral with the spacer 32. Similarly, the addition of a vertical partition (not shown) can also be used to allow for the installation of four small component reels 30 of a narrower width. Similarly, the vertical partition can be frictionally coupled to the bottom and top walls 15 and 16 of the vertical storage compartment 4 or coupled to and made integral with the spacer 32. The vertical partition is also preferably molded of black plastic containing an electro-static dissipative additive to prevent static electricity buildup.

Furthermore, it is possible to install only a vertical partition without the horizontal partition 31 to allow for two large but narrow component reels (not shown) to be installed in a single vertical storage compartment 4. Configuration of the spacer 32 may vary freely from that shown in FIG. 4 and could be nothing more than a block of foam. The spacer 32 need only be of such nature and/or configuration so as to facilitate sufficient translational movement of the actuator 19 when components are placed in the vertical storage compartment 4 and the door 10 is closed.

Figure 5B:
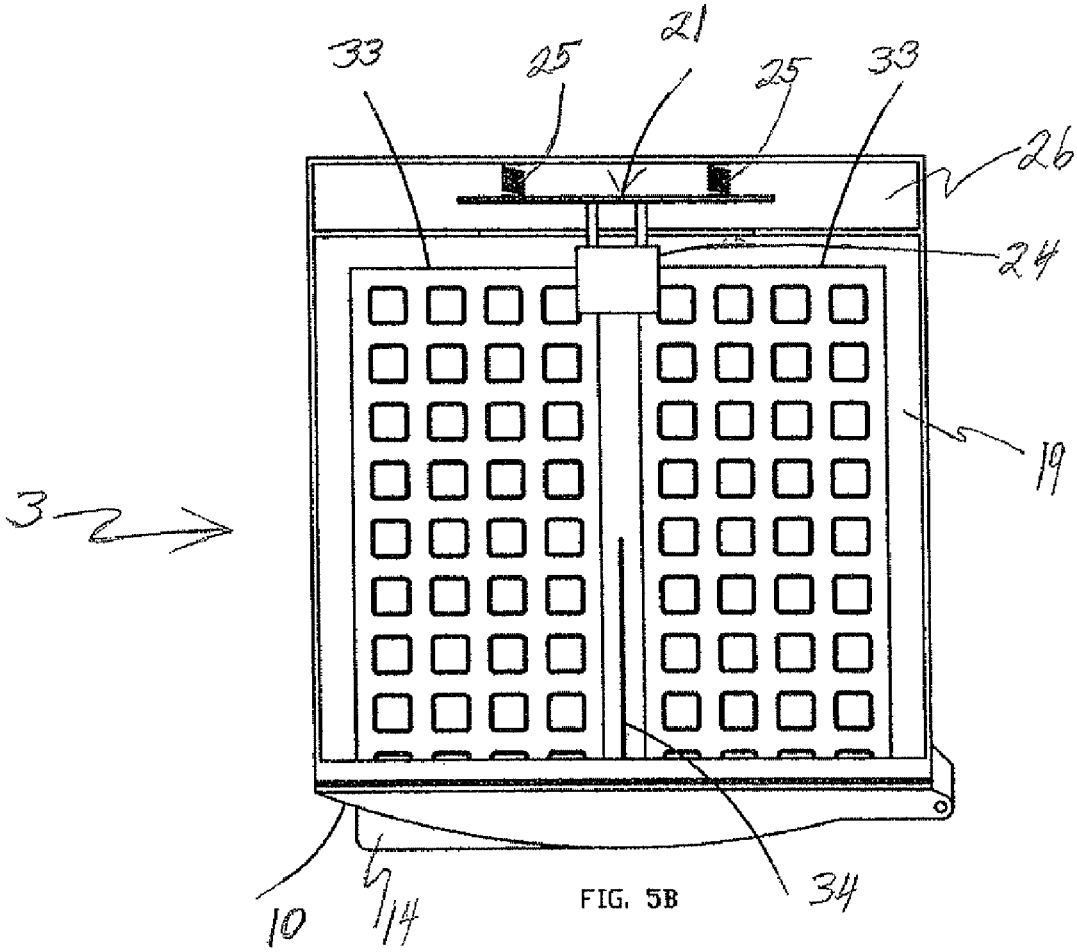
FIG. 5 illustrates one example of component storage waffle trays placed in position within a horizontal component compartment in accordance with the enclosure in FIG. 1A.
Figure 5A:
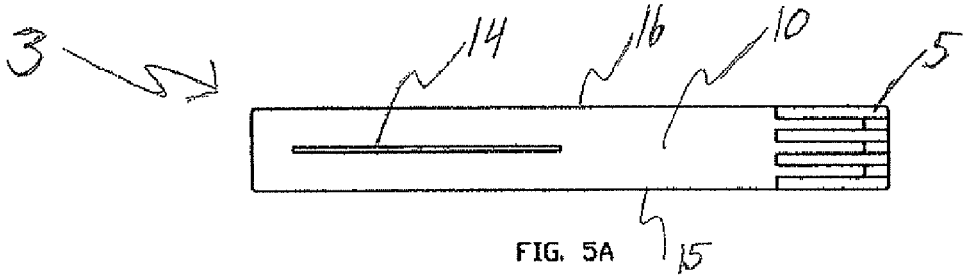

The disclosed embodiment is further described in FIGS. 5A-B which show a horizontal storage compartment 3. The front view of the horizontal storage compartment 3 with the hinge at right 5 and the molded wing 14 coupled to the door 10 is illustrated in FIG. 5A. FIG. 5B is a top view of the horizontal storage compartment 3 showing two component containing waffle trays 33 positioned therein. FIG. 5B illustrates the inside of the main and secondary chambers 19 and 26 with waffle trays 33 being forcibly pushed by the door 10 which in turn is pushing on the actuator 24 causing it to have translationally moved toward the rear wall 18 resulting in an open valve assembly 21 in much the same manner as previously described with respect to FIGS. 3A-C. The opening of the valve assembly 21 thereby exposes the stored components to the dry air supply flowing from the secondary chamber 26 creating a dry storage atmosphere. The waffle trays 33 are illustrated in a separated position by way of a first partition 34. The first partition 34 is preferably frictionally coupled between the bottom and top walls 15 and 16 of the horizontal storage compartment 3. Similarly, a second partition (not shown), mounted 90 degrees from the first partition 34, may also be used to provide a second compartment layer, allowing for the positioning of four waffle trays 33 into the horizontal storage compartment 3.

Figure 6A:
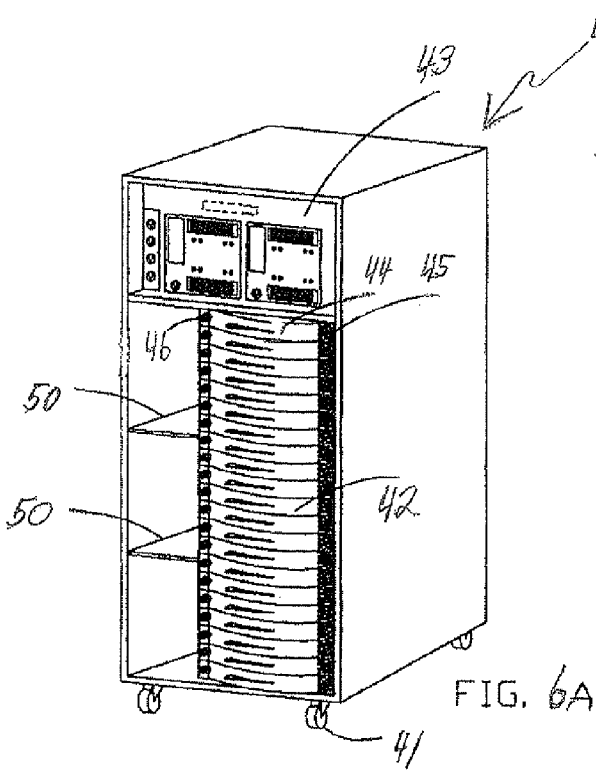
FIG. 6A illustrates an example enclosure in accordance with another embodiment of the present disclosure comprising a plurality of individual component compartments, a dry air delivery system and additional shelving space.

Referring now to FIG. 6A, a disclosure of another embodiment of an enclosure assembly 40 is illustrated. The enclosure assembly 40 of FIG. 6A may be a stationary unit or mounted on wheels 41. The enclosure assembly 40 is shown containing a plurality of horizontal storage compartments 42 and a commercially available de-humidifier 43 capable of delivering a dry air supply to all of the horizontal storage compartments 42. In the configuration depicted, twenty-one horizontal compartments 42 are provided. It should be understood, however, that other horizontal combinations and arrangements of compartments 42 may be provided depending on the needs of a particular application.

The horizontal storage compartments 42 are accessed by doors 44 hinged at the right 45 which allow each door 44 to swing open in a horizontal plane. The doors 44 are held tightly closed against elastomeric seals (not shown in FIG. 6A) by means of latch knobs 46 pivotally coupled to the enclosure assembly 40 so to operatively contact a closed door 44 when rotated 90 degrees clockwise from the unlocked position to the locked position. When doors 44 are closed and forming a sealed contact, the horizontal storage compartments 42 is thus isolated from moist ambient air. Latch knobs 46 are preferably backlit by an LED which glows either red, signifying the unlocked position, or green, signifying the locked position thereby making it easy to quickly identify an unlocked storage compartment 42.

Each door 44 embodies a secondary latch 48 in the form of a spring clip (shown in FIG. 7) which helps to align the door 44 with its horizontal storage compartment 42 and hold the door 44 closed until the primary locking device, latch knob 46, is actuated to the locking position.

The area adjacent to the horizontal storage compartments 42 may be configured in any manner for additional storage; for example, shelves 50 may be configured as shown in FIG. 6A.

Figure 6B:
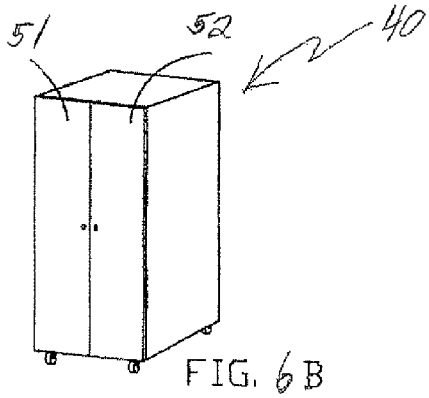
FIG. 6B illustrates the example enclosure of FIG. 6A having additional main front doors in a closed position.

FIG. 6B is a smaller scale drawing of the enclosure assembly 40 showing a first main door 51 and a second main door 52 incorporated into the enclosure assembly 40. These first and second main doors 51 and 52 may be closed for added protection of the contents of the enclosure assembly 40 and locked for added security.

Each of the horizontal storage compartments 42 in enclosure assembly 40 is preferably provided with a bar code label to identify the components stored within. A standard bar code scanner connected to a microprocessor can then be used to locate components within the enclosure assembly 40, as well to provide inventory control by keeping track of which components are held within or removed from the enclosure assembly 40.

Figure 7:
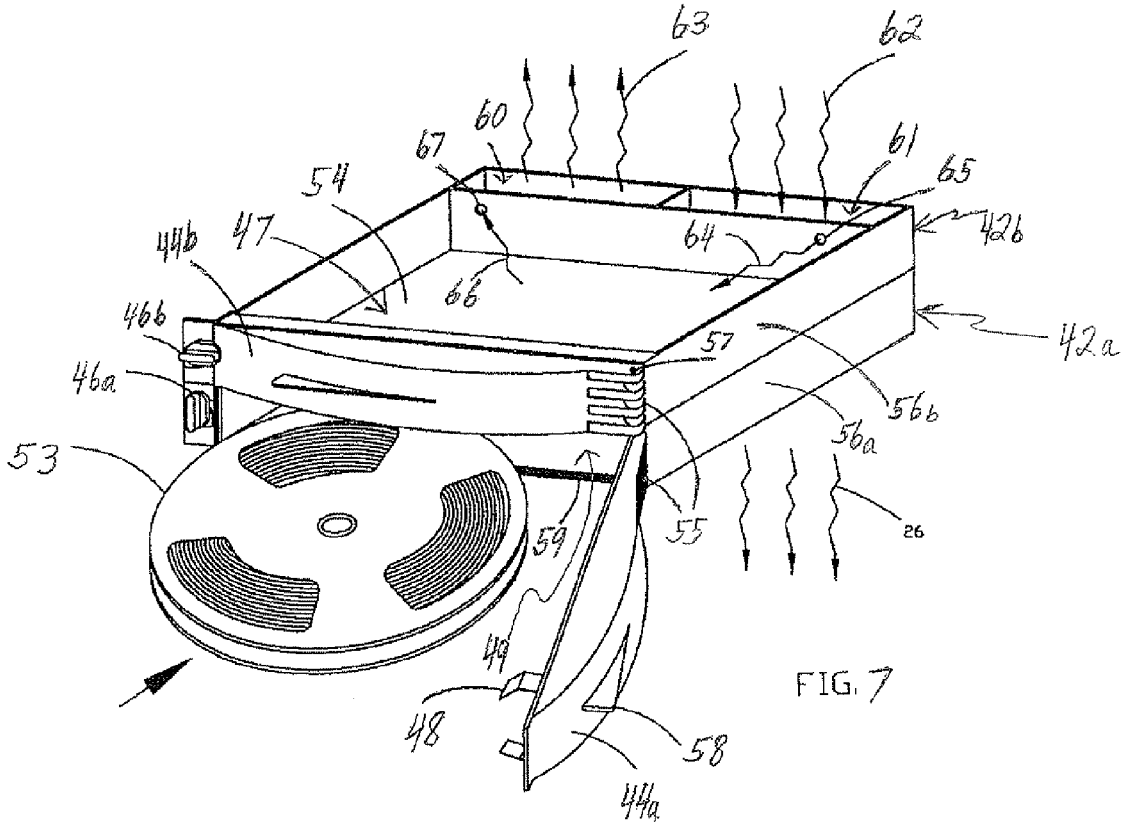
FIG. 7 illustrates the details of an embodiment of a component compartment of the enclosure in FIG. 6A.

In referring now specifically to FIG. 7, the details of the interior and exterior construction of horizontal storage compartments 42 are illustrated by way of two adjacent horizontal storage compartments 42 shown for clarity. FIG. 7 depicts a lower horizontal storage compartment 42*a* shown with its door 44*a* open and ready to accept components for storage, while the upper horizontal storage compartment 42*b* is shown with its door 44*b* closed and latched. Component reel 53 is shown being inserted into the lower horizontal storage compartment 42*a* as just one example of packaged moisture sensitive devices that can be stored in enclosure assembly 40. The horizontal storage compartments 42*a* and 42*b* are preferably constructed of molded black plastic containing an electro-static dissipative additive to prevent static electricity build-up which could cause damage to sensitive electronic components. The doors 44*a* and 44*b* are preferably molded of clear, transparent plastic.

The horizontal storage compartments 42*a* and 42*b* are bonded together so that the bottom wall 54 of horizontal storage compartment 42*b* forms the top wall of horizontal storage compartment 42*a*. Interlocking hinge features 55 are molded into the doors 44*a* and 44*b* and right side walls 56*a* and 56*b* of horizontal storage compartments 42*a* and 42*b* respectively and become connected by hinge pin 57. Additional horizontal storage compartments (not shown) are likewise bonded to each other in a horizontal stack until the desired number is achieved. A flat cover (not shown) is bonded into place to seal the topmost horizontal storage compartment (not shown) in the stack. The door 44*a* is opened manually by grasping and pulling on molded wing 58. A soft elastomeric seal 59 is operatively positioned around the front opening 49 of each of the horizontal storage compartment 42*a* and 42*b* so as to sealingly contact the doors 44*a* and 44*b* when they are in the closed position. A secondary latch 48 is attached to each door 44*a* and 44*b* to align such with its respective front opening 49 and to hold it closed. Latch knob 46*a* adjacent to the lower horizontal storage compartment 42*a* is shown in its counterclockwise or unlocked position, which allows the door 44*a* to be opened and closed. Once the door 44*a* is closed and secondary latch 48 is frictionally engaged, latch knob 46*a* is manually rotated 90 degrees clockwise to further tighten the door 44*a* against the elastomeric seal 59 providing an airtight fit. Door 44*b* of horizontal storage compartment 42*b* is shown in the closed position and held secure by latch knob 46*b* in its clockwise locked position.

At the rear of horizontal storage compartments 42*a* and 42*b* in FIG. 7, there are return air and supply secondary chambers 60 and 61 respectively which are both open at their respective tops and bottoms. With the horizontal storage compartments 42*a* and 42*b* stacked together these secondary chambers 60 and 61 connect to form passages or ducts through which respective return air and dry air is passed via forced convection provided by the dehumidifier 43. More particularly, a first fan (not shown) in the dehumidifier 43 forces dry air, represented by arrows 62, down through the supply secondary chamber 61. A second fan (not shown) in the dehumidifier 43 draws return air, represented by arrows 63, through the return air secondary chamber 60 up into a desiccant chamber (not shown) of the dehumidifier 43. A small amount of bleed air 64 enters each horizontal storage compartment 42*b* through a bleed vent 65 where it circulates before expelled air 66 exits via a return vent 67 into the return air secondary chamber 60. This provides each horizontal storage compartment 42*a* and 42*b* with a continuous purging with dry air to maintain a low humidity environment. Because the dry air 62 supplied in the supply secondary chamber 61 is under slight positive pressure, and the return air 63 in the return air secondary chamber 60 is under slightly negative pressure, the pressure in each horizontal storage compartment 42*a* and 42*b* remains close to neutral (atmospheric).

Thus, for example, when a door 44*b* is opened there is negligible transfer of air between the dry air 62 in the main chamber 47 and the potentially moist ambient outside air due to a lack of any meaningful pressure differentials. Any moist air that does enter the horizontal storage compartment 42*b* is quickly purged once its door 44*b* is again closed forming an air tight seal against the front opening 49 and the latch knob 46*b* is rotated to the locked position. Because the bleed vent 65 and the return vent 67, generally providing for the circulation of dry air 62 through the main chamber 47, are of relatively small diameters there is very little interaction between the various individual horizontal storage compartments 42. As a result, when one door 44 is opened for component access, there is negligible effect on the stored components in other horizontal storage compartments 42. The first and second fans (not shown) in the dehumidifier 43 are preferably operative to continuously operate as long as all the doors 44 to the horizontal storage compartments 42 are closed and their respective latch knobs 46 are in the locked position. Upon the rotation of any one latch knob 46 to a horizontal storage compartment 42 to an unlocked position, internal circuitry associated with the dehumidifier 43 activates to shut off power to the first and second fans.

The present disclosure includes that contained in the appended claims, as well as that of the foregoing description. Although this disclosure has been described in its preferred form in terms of certain embodiments with a certain degree of particularity, alterations and permutations of these embodiments will be apparent to those skilled in the art. Accordingly, it is understood that the above descriptions of exemplary embodiments does not define or constrain this disclosure, and that the present disclosure of the preferred form has been made only by way of example and that numerous changes, substitutions, and alterations in the details of construction and the combination and arrangement of parts may be resorted to without departing from the spirit and scope of the invention.

What is claimed is:

1. An apparatus for storing moisture sensitive devices (MSDs) held in carriers in a dry atmosphere isolated from moist air comprising:

two or more storage compartments in fluid communication with a supply of dry air, each storage compartment comprising:

a main chamber having a front opening;

a secondary chamber in fluid communication with said supply of dry air;

a door functionally coupled to said main chamber operative to form a sealed contact with said front opening; and a valve assembly operatively coupled between said main chamber and said secondary chamber providing fluid communication therebetween, and being functionally operative with said door;

whereby placement of the carrier holding the MSDs in said main chamber of one of said two or more storage compartments and closing said door thereto establishes fluid communication between said secondary chamber and said main chamber allowing said supply of dry air to flow into said main chamber establishing a dry atmosphere around the MSDs, and whereby opening said door halts fluid communication between said main chamber and said secondary chamber thereby preventing moist air from entering into said secondary chamber and into said main chamber of another of said two or more storage compartments while said door is open.

2. The apparatus for storing MSDs as recited in claim 1, wherein said main chamber further comprises an opening, and said valve assembly is comprised of an actuator coupled to a baffle, said baffle sized and positioned to be functionally operative to sealingly close said opening upon contemporaneous movement of said door to the open position and the carrier towards said door.

3. The apparatus for storing MSDs as recited in claim 2, wherein said valve assembly further comprises a spring functionally coupled between said baffle and said secondary chamber providing operative force on said baffle.

4. The apparatus for storing MSDs as recited in claim 1, wherein said two or more storage compartments are comprised of horizontal storage compartments operatively coupled to form one or more column.

5. The apparatus for storing MSDs as recited in claim 1, wherein said two or more storage compartments are comprised of vertical storage compartments operatively coupled to form one or more row.

6. The apparatus for storing MSDs as recited in claim 1, wherein said two or more storage compartments are comprised of a combination of horizontal and vertical storage compartments operatively coupled to form one or more column and one or more row.

7. The apparatus for storing MSDs as recited in claim 1, further comprising at least one bar code label coupled to at least one of said two or more storage compartments.

8. The apparatus for storing MSDs as recited in claim 1, further comprising a dehumidifier, said dehumidifier being in fluid communication with each of said secondary chambers and providing said supply of dry air.

9. The apparatus for storing MSDs as recited in claim 1, wherein said main chamber is sized to receive a partition to facilitate the placement of multiple carriers holding MSDs.

10. The apparatus for storing MSDs as recited in claim 2, wherein said valve assembly further comprises a spacer functionally coupled to said actuator to facilitate operable interaction with carriers holding MSDs.

* * * * *